US007055763B2

(12) United States Patent
Torigoe

(10) Patent No.: US 7,055,763 B2
(45) Date of Patent: Jun. 6, 2006

(54) MIST GENERATING DEVICE

(75) Inventor: Kenji Torigoe, Nagoya (JP)

(73) Assignee: Sera Corporation Inc., Aichi (JP)

( * ) Notice: Subject to any disclaimer, the term of this patent is extended or adjusted under 35 U.S.C. 154(b) by 0 days.

(21) Appl. No.: 10/504,857

(22) PCT Filed: Feb. 28, 2003

(86) PCT No.: PCT/JP03/02296

§ 371 (c)(1),
(2), (4) Date: Aug. 27, 2004

(87) PCT Pub. No.: WO03/073976

PCT Pub. Date: Sep. 12, 2003

(65) Prior Publication Data

US 2005/0121540 A1 Jun. 9, 2005

(30) Foreign Application Priority Data

Mar. 1, 2002 (JP) ..... 2002-056336
Feb. 12, 2003 (JP) ..... 2003-033971

(51) Int. Cl.
*F22B 29/06* (2006.01)

(52) U.S. Cl. ..... 239/135; 239/124; 239/127; 219/523; 392/398; 392/324

(58) Field of Classification Search ..... 239/120–122, 239/135, 289, 329, 127; 219/523; 392/386, 392/394, 397, 398, 399, 402, 403, 404–406
See application file for complete search history.

(56) References Cited

U.S. PATENT DOCUMENTS 3,539,110 A * 11/1970 Kobayashi ..... 239/223
4,038,347 A * 7/1977 Mickley ..... 261/30
4,114,022 A * 9/1978 Braulke, III ..... 392/383
4,588,425 A * 5/1986 Usry et al. ..... 96/245
4,993,639 A * 2/1991 Hata ..... 239/289
5,483,616 A * 1/1996 Chiu et al. ..... 392/406
5,490,957 A * 2/1996 Lasko et al. ..... 261/29
6,371,388 B1 * 4/2002 Utter et al. ..... 239/419

FOREIGN PATENT DOCUMENTS

JP 08-049801 2/1996
JP 11-022907 1/1999
JP 2001-193973 7/2001

* cited by examiner

*Primary Examiner*—David A. Scherbel
*Assistant Examiner*—Seth Barney
(74) *Attorney, Agent, or Firm*—Arent Fox PLLC

(57) ABSTRACT

A mist generating apparatus having a casing that is divided into a storage chamber, a pump chamber, a waterwheel chamber and a mist chamber. The storage chamber is provided with a water storage tank having a heater, while the pump chamber is provided with a pump. A waterwheel located in the waterwheel chamber and a fan located in the mist chamber are provided around a rotating axis so as to rotate together, and then warm water in the water storage tank is sprayed onto the waterwheel by means of the pump, whereby mist is generated. The generated mist is guided to the mist chamber by means of the fan with warm air from a warm air generator and is discharged from an outlet.

8 Claims, 4 Drawing Sheets

MIST GENERATING DEVICE

CROSS-REFERENCE TO RELATED APPLICATION

This application is a National Stage entry of International Application Number PCT/JP03/02296, filed Feb. 28, 2003. The disclosure of the prior application is hereby incorporated herein in its entirety by reference.

BACKGROUND OF THE INVENTION

1. Field of the Invention

The present invention relates to a mist generating apparatus for a low-temperature sauna which can be easily used in a bathroom. 2. Description of Prior Art Presently there are various methods for generating mist. In these methods, an overwhelmingly popular method for generating mist is to spray relatively warm water onto a waterwheel, because low-temperature saunas are typically enjoyed in bathrooms and a flash water heater with a relatively warm water shower is commonly used. Thus, demand for such a mist generating apparatus is rapidly increasing.

However, such mist generating apparatuses have developed a reputation for generating negative ions by the action of Lenard's effect, and many people are interested in it.

As described above, a conventional mist generating apparatus works as follows: relatively warm water is sprayed onto a waterwheel and fine water drops generated by spraying are used As mist. Therefore, a bathroom becomes a low-temperature sauna room in a few minutes by connecting a hose tip not to a shower nozzle but to the apparatus, and turning on a faucet.

It is true that customers rarely complain about setting up the apparatus because connecting a hose of the flash water heater in a bathroom to the apparatus is a simple step. Further, even if a flash water heater is not provided in the bathroom, plumbing is easy as long as a water heating apparatus is installed.

However, according to a survey, many potential buyers who use old-styled bath heaters desire to set a mist generating apparatus with a simple plumbing even when a water heating apparatus is not installed in their bathrooms.

Moreover, in the conventional apparatus, warm water is inefficiently used since no more than 5% of the warm water turns into mist when it is sprayed onto the waterwheel, while the rest of the warm water just runs down as warm water.

BRIEF SUMMARY OF THE INVENTION

An object of the invention is to provide a mist generating apparatus which has an increased warm water efficiency and is utilized in bathrooms even where a water heating apparatus is not installed. The apparatus includes a waterwheel, a fan, a water storage tank, a pump that sprays water in the water storage tank onto wings of the waterwheel so as to rotate the waterwheel, a waterwheel chamber which covers at least the whole waterwheel and includes a fresh air inlet, and a mist chamber which covers the entire fan, including an inlet to which the rotating fan guides mist, which is generated when the water is sprayed onto the waterwheel, from the waterwheel chamber, and includes an outlet for discharging the guided mist outside using the rotating fan. The invention further includes a drained water collector which collects drained water splashed and dripped while being sprayed onto the waterwheel and returns the collected water to the water storage tank, a heater which maintains the temperature of water in the water storage tank at appropriate temperature, and a power chord which receives electric power from a commercial power source.

It should be noted that the waterwheel and the fan may be coaxial or connected with each other through a rotation transmission mechanism and that a heater may be provided with the water storage tank. In addition, the waterwheel chamber and the mist chamber may be integrated and a wall having the mist inlet provided for separating an area in which the waterwheel is disposed and an area in which the fan is disposed. The water storage tank may be disposed under the mist chamber, and a sterilization apparatus may be incorporated.

Moreover, a mist heater may be provided with the mist generating apparatus and a warm air generator used as the mist heater.

DETAILED DESCRIPTION OF THE INVENTION

Embodiments of a mist generating apparatus according to the present invention will be explained with reference to the drawings.

Figure 1:
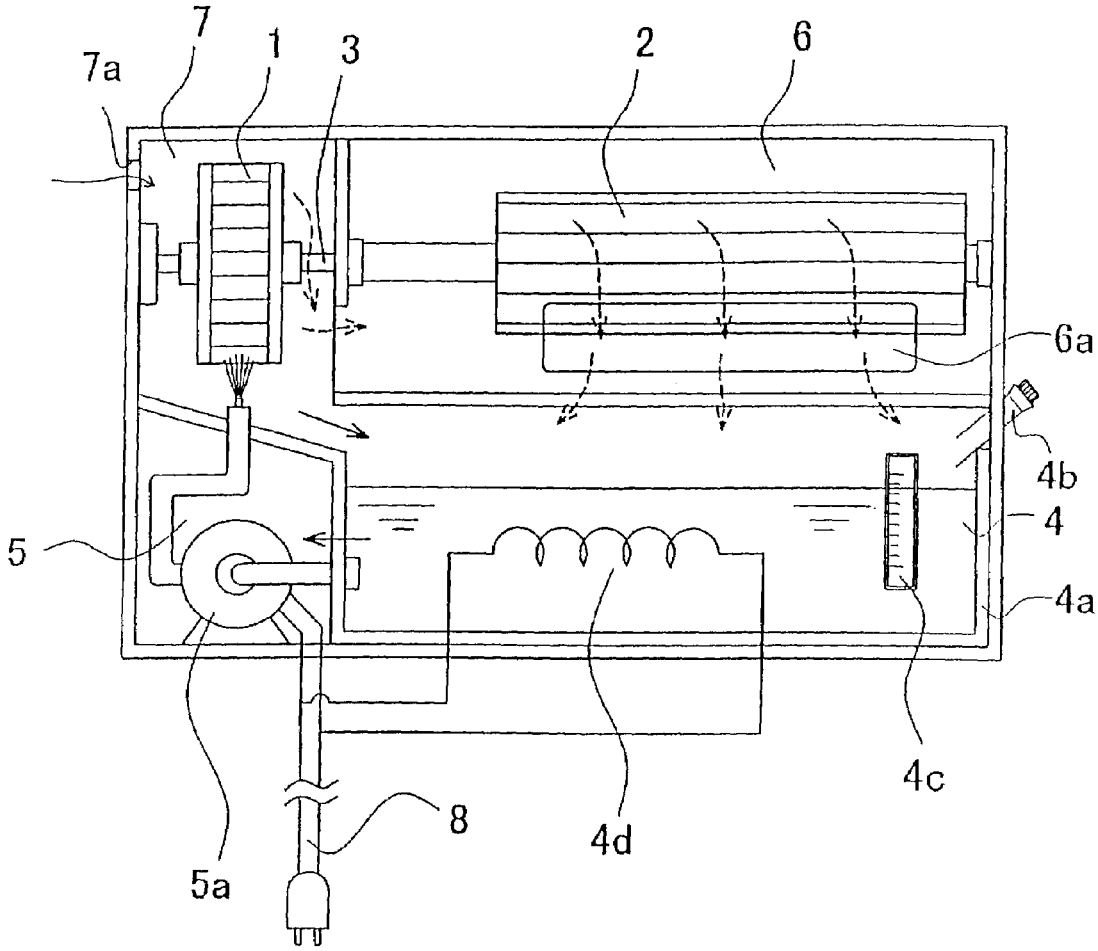
FIG. 1 is a plan view of a mist generating apparatus according to an embodiment of the present invention.

FIG. 1 is a mist generating apparatus in which all elements except a power chord are housed in a case, thereby having a neat appearance. The reference number 1 denotes a waterwheel and the reference number 2 denotes a fan, and both are provided around a rotating axis 3 having two ends supported so as to rotate freely. Accordingly, the waterwheel, the fan and the rotating axis can rotate together.

The case has an upper portion and a lower portion, the lower portion being divided into a storage chamber 4 and a pump chamber 5, while the upper portion includes a mist chamber 6 and a waterwheel chamber 7.

The storage chamber 4 has a built-in water storage tank 4*a*, a water inlet 4*b*, an inspection hole 4*c* and a heater 4*d* which is installed therein.

The pump chamber 5 adjacent to the storage chamber 4 has a pump 5*a* which suctions warm water in the water storage tank 4*a* and sprays the same onto the waterwheel 1 disposed in the waterwheel chamber 7 located at the upper portion.

The bottom part of the waterwheel chamber 7 slopes down toward the storage chamber 4 to communicate with the same, whereby a drained water collector is established in which drips of drained water are introduced to the storage chamber.

The mist chamber 6 also communicates with the waterwheel chamber 7. Accordingly, when mist is generated in the mist chamber 7 by spraying warm water onto the waterwheel, the mist is introduced to the mist chamber 6 by the fan 2 rotating together with the waterwheel 1. Then, the mist is discharged from an outlet 6*a* opening at the front of the mist chamber 6.

The waterwheel chamber 7 has a fresh air inlet 7*a* in order to help the flow of the mist into the mist chamber 6.

A power chord provides electricity to the heater 4*d* and the pump 5*a* from a commercial power source. Electric isolation and water leak prevention are established in the case and further a perfect temperature management system is performed by sensors disposed at several places and a built-in computer (not shown).

In the mist generating apparatus configured in this manner, first, water is poured into the water storage tank 4*a* through the water inlet 4*b* until the water reaches a predetermined amount. Then, the water inlet 4*b* is closed and the electric power is turned ON, that is, the mist generating apparatus is in a standby mode until the water temperature reaches an appropriate level.

When the water in the water storage tank 4*a* reaches the appropriate temperature, notification is performed, for example, a red lamp showing a standby mode turns into a blue lamp showing an operation mode, and the pump 5*a* automatically operates.

When warm water in the water storage tank 4*a* is sprayed onto the waterwheel 1 by the pump 5*a,* the waterwheel 1 is rotated, and accordingly, the fan 2 is rotated. Thereafter, the waterwheel chamber 7 is filled with splashed water, some of which becomes fine water drops to be suctioned into the mist chamber 6, and the other water drops downward and becomes drained water to be collected into the water storage tank 4*a.*

Mist in the mist chamber 6 is rather intensely emitted out from the outlet 6*a* such that a bathroom is filled with the mist.

The temperature of the water storage tank 4*a* is kept at an appropriate level according to the temperature of the discharged mist.

The mist generating apparatus thus configured is portable, so that it can be mounted at any place as long as the electric power is obtained. Moreover, the mist generating apparatus can operate without a water heating apparatus. Particularly, in the apparatus of the above embodiment, as the waterwheel and the fan rotate together around the same axis, it is unnecessary to provide driving power to rotate the fan.

Figure 2:
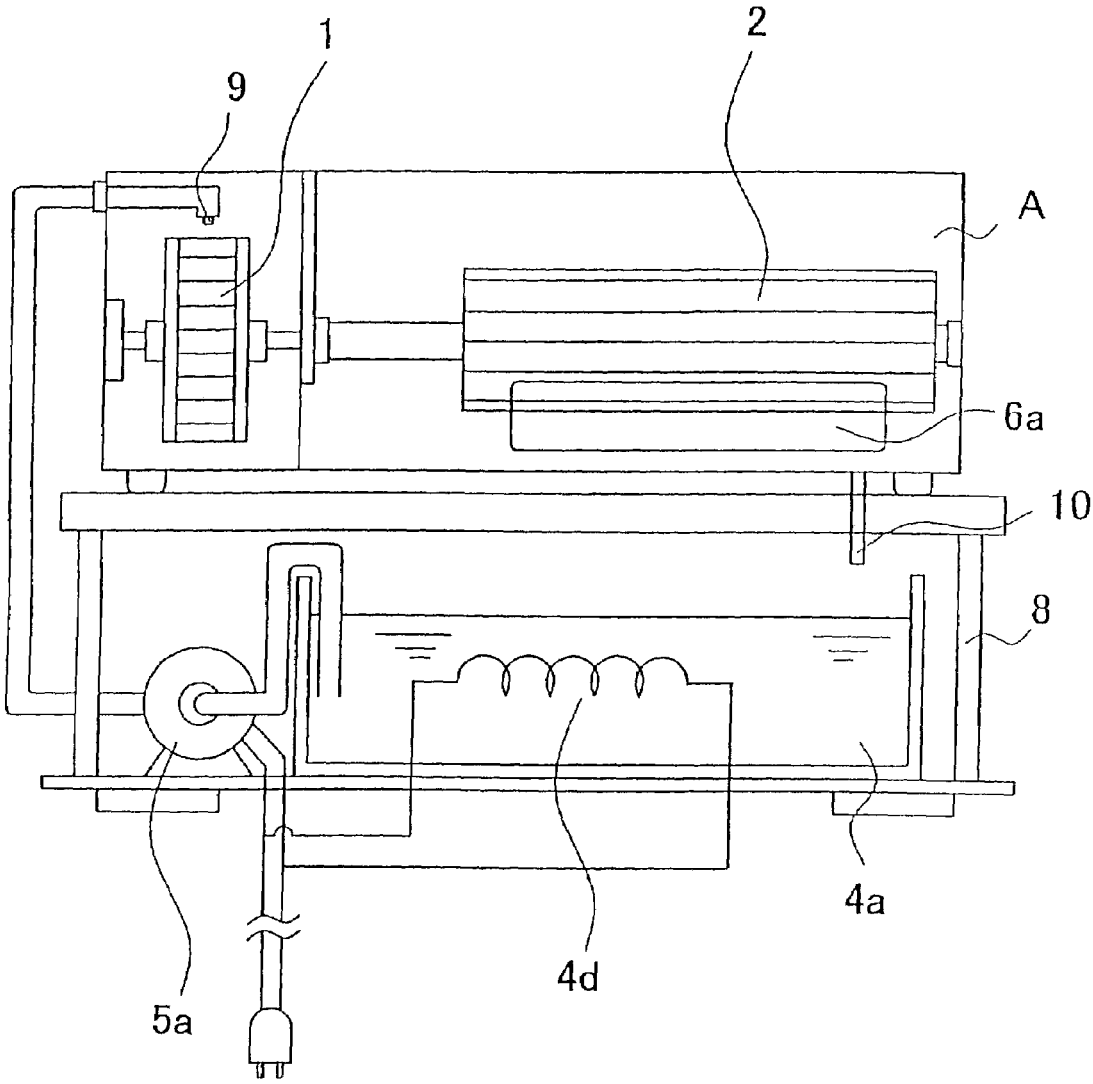
FIG. 2 is a plan view of an alternate embodiment of the present invention.

The above embodiment is a unit type in which the water storage tank and the pump are incorporated in the case, but the apparatus of the present invention is not limited to the above embodiment. As shown in FIG. 2, the present invention is applicable to a separate type unit as follows. First, a conventional mist generating unit A using warm water provided from a water heating apparatus or a flash water heater is disposed on a rack 8, which has a water storage tank 4*a* and a pump 5*a.* Thereafter, a nozzle 9 for spraying the warm water onto a waterwheel is connected with a pipe from the pump 5*a,* and drained water in the mist generating unit A is discharged into the water storage tank 4*a* via a drained water outlet 10. With this configuration, drained water is efficiently collected, and a user can select either the single mist generating unit or the mist generating apparatus including the unit, tank and pump.

The heater can be mounted at any place on a circulation route, and it is effective to conduct temperature management if the heater is disposed in the water storage tank. Moreover, a sub tank may be provided between the waterwheel chamber (the mist chamber) and the water storage tank. In the sub tank, cooled water collected as drain water is boiled, thereby a sudden change of water temperature in the tank can be prevented even if the heating power of the heater in the water storage tank is not high. In addition, *Legionella* bacteria are killed with a sterilization effect by the heating.

Besides the above-mentioned sub tank with a heater for sterilization, a sterilization apparatus such as an ozone generator may be applied.

The fan may be driven by a motor which is separately provided, other than the above-mentioned structure in which the fan rotates with the waterwheel together.

During cold weather, the temperature of warm water is likely to drop significantly.

The above problem is overcome to some extent by intensifying the heater in the water storage tank. However, increased electric power consumption is not desirable and when it is cold in the bathroom a user still feels cold even if mist itself is at a hot temperature, so that the user cannot obtain the feeling of a sauna bath.

In order to resolve the problem, a mist heater can be added.

Figure 3:
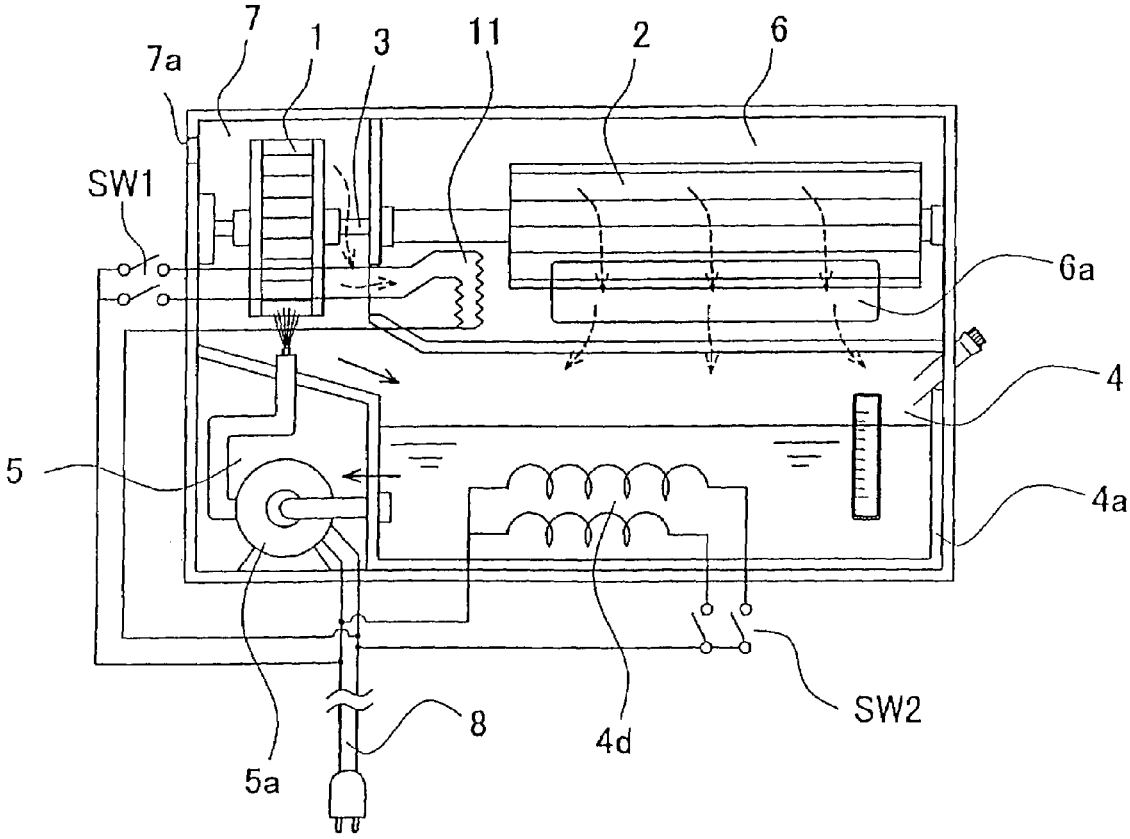
FIG. 3 is a plan view of an alternate embodiment of the present invention wherein a mist heater is added.

FIG. 3 shows an embodiment in which heating performance is intensified by adding the mist heater. The features which are the same as the prior embodiment are denoted with the same reference numbers and will not be explained.

In the mist chamber 6, a heater 11 as the mist heater is incorporated therein.

The heater 11 is a drip-proof type, and when a pair of heaters is provided, it is possible to switch heating power to high/low by using a switch SW1.

Further, a heater 4*d* is provided in the storage chamber 4. In this heater 4*d,* it is possible to switch heating power to high/low by using a switch SW2.

As the mist chamber 6 can be heated, it is possible to maintain the temperature of mist discharged from the outlet 6*a* at high temperature, so that the user can obtain the pleasant feeling provided by a sauna bath even when it is extremely cold.

In addition, as the mist chamber and the storage chamber apply the heater where heating power can be switched to high/low, the best combination in heat efficiency can be selected by changing the heating power of the heater 11 and 4*d* to high/low according to use conditions.

This is effective to achieve power saving.

Other than incorporating the heater into the mist chamber, the mist heating apparatus can be provided with a built-in or an external warm air generator.

Figure 4:
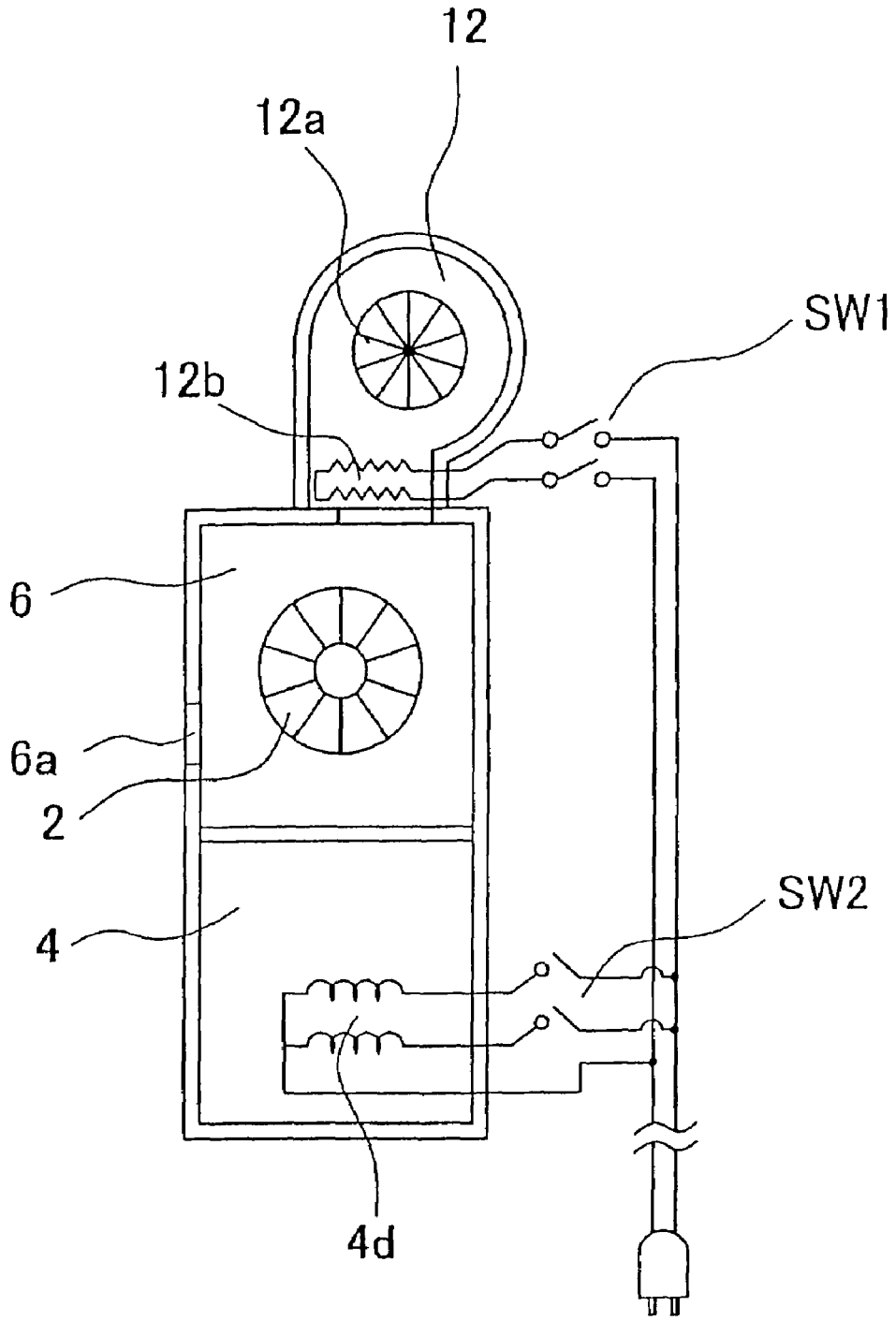
FIG. 4 is a side view of an alternate embodiment of the present invention wherein a warm air generator is used as a mist heater.

FIG. 4 shows an example of an external warm air generator. A warm air generator 12 is provided on the mist chamber 6 in order to blow warm air into the mist chamber 6.

The warm air generator 12 has a heater 12*b* incorporated into an outlet of a blower 12*a,* which is similar to hair dryers as home electric appliances.

Also in the mist generating apparatus of this embodiment, a heater 4*d* is installed in the water storage tank 4. In both the heater 4*d* installed in the water storage tank 4*d* and the heater 12*b* installed in the warm air generator 12, heating power can be switched to high/low by switches SW1, SW2.

In the mist generating apparatus formed in this manner, temperature rise in the initial operation is quick and the cold bathroom can obtain ideal sauna conditions in a short time because the heater 4*d* is installed in the water storage tank 4 in addition to the heater 12*b.*

Further, since the warm air generator 12 is provided externally, it may be an option which a purchaser can add to his apparatus in accordance with his need.

According to the invention, additional warm water supply is unnecessary and utilization ratio of water can be almost 100% because no drained water is discharged from the case.

Moreover, the apparatus is portable, so that low-temperature sauna can be enjoyed in any kind of bathroom as long as a power source is provided.

In addition, when the waterwheel and the fan are coaxial or connected with each other through a rotation transmission mechanism, a power source for driving the fan is unnecessary. Moreover, when a heater is provided with the water storage tank, temperature management can be done more accurately.

Further, a mist chamber can be used as a mist generating unit when the waterwheel is disposed in the mist chamber and a wall including a mist inlet is provided between an area where the waterwheel is disposed and an area where the fan is disposed. Moreover, when the water storage tank is provided below the waterwheel in the waterwheel area of the mist chamber, drained water can be efficiently collected. Further, when a sterilization apparatus is provided in the water storage tank, an increase of *Legionella* bacteria can be prevented.

Further, when the mist heating means is applied, ideal sauna conditions can be obtained in a cold bathroom even if it is extremely cold outside. Particularly, when a warm air generator is added as the mist heating means, it is likely to save time for temperature rise in the bathroom.

What is claimed is:

1. A mist generating apparatus comprising:

a waterwheel;

a fan;

a water storage tank;

a pump that sprays water from the water storage tank to wings of the waterwheel so as to rotate the waterwheel, wherein mist is generated when the water is sprayed onto the waterwheel;

a waterwheel chamber which covers at least the whole waterwheel and includes a fresh air inlet;

a mist chamber which covers the entire fan, and includes an inlet to which the rotating fan guides mist from the waterwheel chamber, and an outlet for discharging the guided mist outside using the rotating fan;

a drained water collecting means which collects and returns the drained water into the water storage tank, the drained water splashing and dripping when it is sprayed to the waterwheel;

a heater which maintains the temperature of water in the water storage tank at appropriate temperature, and a power chord which receives electric power from a commercial power source.

2. A mist generating apparatus according to claim 1, wherein the waterwheel and the fan are coaxial.

3. A mist generating apparatus according to claim 1, wherein a heater is disposed in the water storage tank.

4. A mist generating apparatus according to claim 1, wherein the waterwheel chamber and the mist chamber are integrated and a wall having the mist inlet is provided for separating an area in which the waterwheel is disposed and an area in which the fan is disposed.

5. A mist generating apparatus according to claim 4, wherein the water storage tank is disposed under the mist chamber.

6. A mist generating apparatus according to claim 1, further comprising a sterilization apparatus.

7. A mist generating apparatus according to claim 1, further comprising a mist heating means.

8. A mist generating apparatus according to claim 7, wherein the mist heating means is a warm air generator.

* * * * *